United States Patent [19]

Proffitt et al.

[11] Patent Number: 5,012,928

[45] Date of Patent: May 7, 1991

[54] STACKABLE FOOD CONTAINER WITH LID

[75] Inventors: James R. Proffitt, Dublin; Dale S. Richardson, Westerville, both of Ohio

[73] Assignee: Borden, Inc., Columbus, Ohio

[21] Appl. No.: 549,224

[22] Filed: Jul. 6, 1990

Related U.S. Application Data

[63] Continuation-in-part of Ser. No. 348,192, May 5, 1989, abandoned, and a continuation-in-part of Ser. No. 495,932, Mar. 19, 1990.

[51] Int. Cl.[5] ..... B65D 21/02; B65D 41/62

[52] U.S. Cl. ..... 206/508; 206/518; 206/519; 220/258; 220/259; 220/306; 220/339; 220/359

[58] Field of Search ..... 206/503, 508, 509, 511, 206/518, 519; 220/74, 306, 324, 326, 337, 339, 359, 258, 270

[56] References Cited

U.S. PATENT DOCUMENTS

| | | | |
|---|---|---|---|
| Re. 32,739 | 8/1988 | Terauds | 220/306 |
| 2,873,782 | 2/1959 | Gunn | 206/518 X |
| 2,960,134 | 11/1960 | Fornas | 206/503 |
| 3,044,611 | 7/1962 | Tupper | 220/306 X |
| 3,082,903 | 3/1963 | Stevens et al. | 220/339 |
| 3,117,692 | 1/1964 | Carpenter et al. | 220/306 |
| 3,214,074 | 10/1965 | Schechter . | |
| 3,233,812 | 2/1966 | Kennedy | 206/518 X |
| 3,362,575 | 1/1968 | Fotos | 220/306 X |
| 3,384,263 | 5/1968 | Bernstein | 220/306 |
| 3,410,698 | 11/1968 | Sosin . | |
| 3,419,184 | 12/1968 | Asenbauer | 220/329 X |
| 3,424,342 | 1/1969 | Scopp et al. | 220/306 |
| 3,434,625 | 3/1969 | Embry, Jr. | 206/518 X |
| 3,452,896 | 7/1969 | Elliot | 220/306 |
| 3,483,964 | 12/1969 | Muehling et al. . | |
| 3,502,486 | 3/1970 | Lundquist . | |
| 3,620,411 | 11/1971 | Rump | 229/2.5 R X |
| 3,651,983 | 3/1972 | Haugen | 220/326 |
| 3,710,975 | 1/1973 | Jansen | 220/339 |
| 3,759,416 | 9/1973 | Constantine | 206/508 X |
| 3,904,074 | 9/1975 | Hoffman et al. | 220/339 |
| 3,942,676 | 3/1976 | Beckers et al. | 220/270 |
| 3,967,731 | 7/1976 | Boduch | 206/508 |
| 4,044,941 | 8/1977 | Knudsen | 220/258 |
| 4,206,845 | 6/1980 | Christian | 206/508 |
| 4,358,025 | 11/1982 | Urion | 220/258 |
| 4,401,229 | 8/1983 | Bell et al. | 220/259 |
| 4,427,705 | 1/1984 | Wyslotsky et al. . | |
| 4,440,311 | 4/1984 | Hoffman et al. | 220/306 |
| 4,466,553 | 8/1984 | Zerger | 220/306 X |
| 4,494,650 | 1/1985 | Cullen | 229/2.5 R X |
| 4,529,100 | 7/1985 | Ingemann | 220/359 |
| 4,738,374 | 4/1988 | Ingemann | 220/258 |
| 4,756,425 | 7/1988 | Wise | 206/518 X |
| 4,795,055 | 1/1989 | Ingemann | 220/270 |
| 4,848,580 | 7/1989 | Wise | 206/519 |
| 4,856,674 | 8/1989 | Berney | 220/258 |

FOREIGN PATENT DOCUMENTS

| | | |
|---|---|---|
| 1057211 | 2/1967 | United Kingdom . |

*Primary Examiner*—Bryon P. Gehman
*Attorney, Agent, or Firm*—Sidney W. Millard

[57] ABSTRACT

This invention relates to a resealable package for holding goods which may be perishable such as cheese. A tray is structured to hold the goods and a cover fits over the top of the tray to seal and reclose the package as goods are removed. The empty tray is stackable for shipment in nested fashion and includes a ledge to space the trays to facilitate separation.

7 Claims, 3 Drawing Sheets

STACKABLE FOOD CONTAINER WITH LID

This is a continuation-in-part of application Serial No. 348,192, filed May 5, 1989, now abandoned and application Serial No. 495,932, filed March 19, 1990.

FIELD OF THE INVENTION

This invention relates to a tray with a lid or over to seal or reclose the tray against oxygen and airborne debris which may cause mold or otherwise contaminate the contents of the package and minimize moisture loss of the contents.

BACKGROUND OF THE INVENTION

Work was done on this invention primarily to provide a container for marketing cheese slices. The product could be sold to the public, then the customer could open the package, extract some of the cheese slices, and then reclose the package to reduce the oxidation and drying of the cheese. It is desirable to increase the shelf life of all food products which could be contained within the package, and restricting the flow of oxygen to and moisture from the food product tends to prolong its shelf life. The reclosability of the package itself also helps to insure that dust and other debris floating in the air will not have access to the products after it is opened.

The tray and cover combination of this invention is useful for other products than cheese and, indeed, the package could be reused to hold other products after the goods initially contained have been used and the package washed for reuse.

Containers which are stackable and having corner shelves to hold them in separated position are disclosed in the patent to Fornas, U.S. Pat. No. 2,960,134.

Containers which are resealable or partially resealable after the contents of the package are partially used are not new. A patent to Stevens et al, U.S. Pat. No. 3,082,903, discloses a container with an integral lid, the two parts being hinged together. A patent to Schechter, U.S. Pat. No. 3,214,074, teaches a container which is hermetically sealed at the top, while below the hermetic seal is a reusable inner lid. The lid fits in a groove around the inside surface of the tray but the tabs allowing removal of the lid also allow air to reach the package contents. The structure of the lid inherently allows the incursion of oxygen and airborne debris.

A patent to Sosin, U.S. Pat. No. 3,410,698, discloses a package for luncheon meats where the two halves of the package are hinged along one edge and are virtually mirror images of each other. The disclosure indicates that it is "resealable", but there is nothing in the disclosure which tells one how the resealing would take place. Apparently the only force to reseal the package is gravity.

A patent to Muehling et al., U.S. Pat. No. 3,483,964, discloses a conventional blister pack which is hermetically sealed at the outset, but has no substantial disclosure of how one would reseal the package to prevent the incursion of undesirable oxygen and debris after it is opened.

The patent to Lundquist, U.S. Pat. No. 3,502,486, discloses a reusable, four sided, blister pack for food where the tray portion of the container is hinged to the lid portion along one side, and a resealable edge is provided on the diagonally opposite side. There is no means for resealing along the other two of the four sides.

The patent to Constantine, U.S. Pat. No. 3,759,416, discloses vertically extending ribs in a container sidewall to provide mechanical stability.

The patent to Wyslotsky et al., U.S. Pat. No. 4,427,705, discloses a reusable package for commestibles involving two parts pressed together to hold goods therebetween and having a detent-type latch means along one side.

The patent to Wise, U.S. Pat. No. 4,848,580, discloses a tray and cover formed of thermoplastic resin having vertically extending flutes in the sidewall to increase mechanical stability.

There is a need in the industry for a food package which is resealable or reclosable by positive mechanical means after the package has been opened and a portion of the contents removed.

SUMMARY OF THE INVENTION

This invention provides such a package. It involves a resin tray having a generally flat bottom with upwardly extending sidewalls to contain whatever product it is desired to contain. Flutes and ridges are formed in the plastic sidewalls of the tray to provide structural integrity. Thermoplastic resin is the preferred material for forming the tray but other materials may be appropriate under certain circumstances.

A cover or lid is provided to cover the open top of the tray. The cover includes structure about its periphery to sealingly engage or otherwise insure close contact between the cover and the open top of the tray to minimize the incursion of oxygen and airborne debris or minimize moisture loss of contents. Easy manual removal of the cover from the top of the tray to provide easy access to the contents is achieved. Easy resealable movement after the desired goods have been removed from the tray is a feature most desirable to users of the product. With the reclosability of the package it is unnecessary to repackage the contents when the user does not consume the whole of the goods.

Objects of the invention not clear from the above will be fully understood by a review of the drawings and the description of the preferred embodiments which follow.

BRIEF DESCRIPTION OF THE DRAWINGS

Preferred embodiments of the commestible package of the present invention are shown by way of illustration in the accompanying drawings, wherein.

DESCRIPTION OF THE PREFERRED EMBODIMENTS

Figure 1:
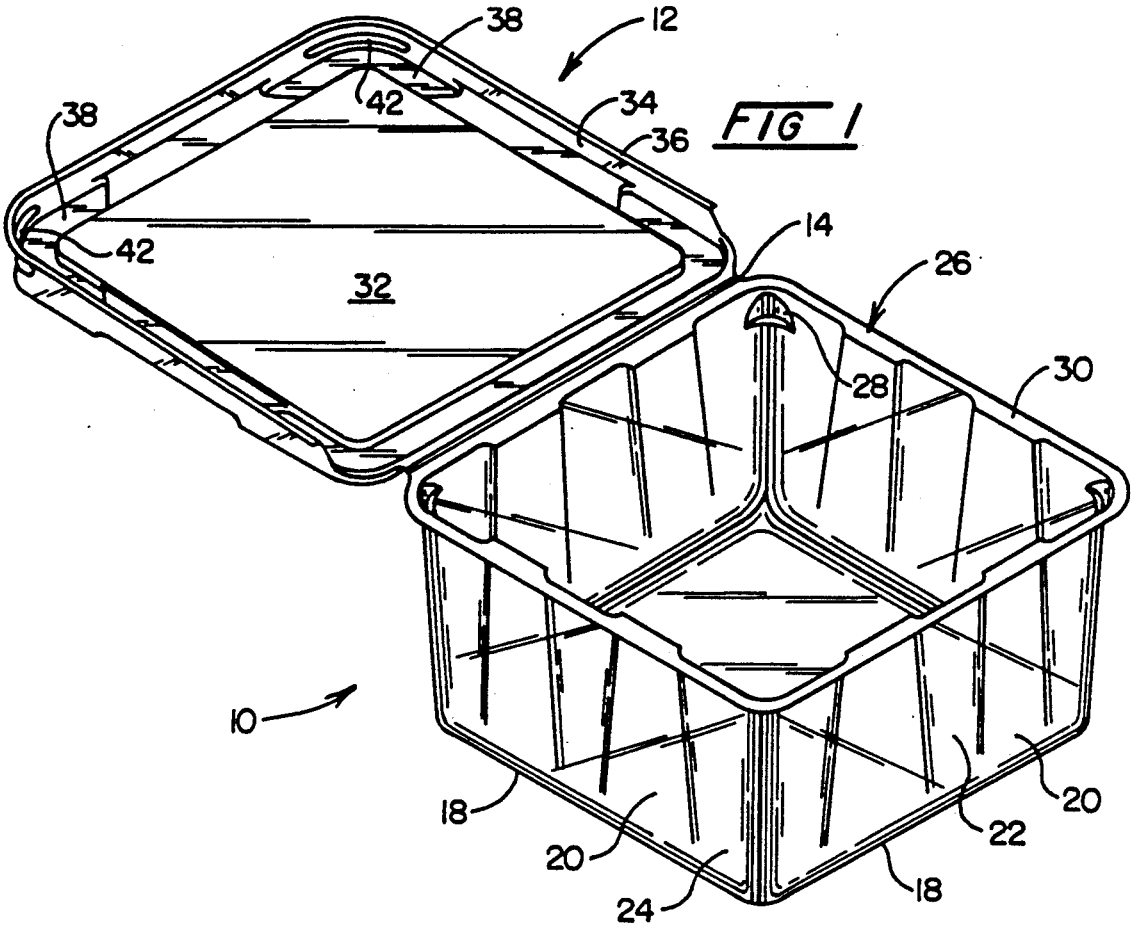
FIG. 1 is a perspective view of a tray and cover in combination mechanically hinged together along one side.
Figure 2:
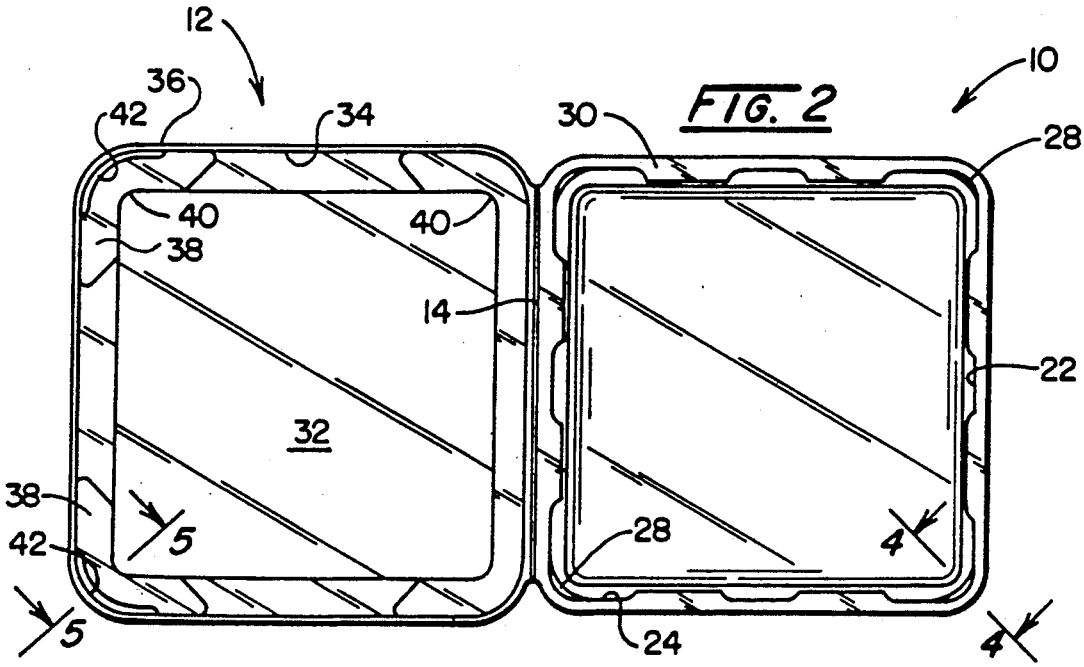
FIG. 2 is a top plan view of the fully opened tray illustrated in FIG. 1.

All of the parts of the package as subsequently described in all the embodiments are preferably formed of clear thermoplastic resin for purposes of attractively visually displaying the contents of the package.

Looking particularly to FIGS. 1–5, a tray 10 is attached to a cover or lid 12. The tray and cover are shown in FIGS. 1–5 as being formed integrally and pivoted together by a hinge 14. The hinge may be formed by one or a plurality of grooves, score lines or bridge-cut perforations in the plastic.

Tray 10 has a flat bottom 16 with rounded corners 18 at its periphery. Said corners 18 extend between the flat bottom 16 and upstanding planar sidewalls 20. Sidewalls 20 and bottom 16 are approximately perpendicular to each other although there may be a slight vertical divergence of the sidewalls to assist in disengaging stored nested trays as will be explained in more detail subsequently.

Projecting radially outward of the sidewalls 20 are a plurality of flutes 22, 24. In the illustrated embodiments there is a single flute 22 located at approximately the middle of each of the sidewalls, while corner flutes 24 project outwardly around each corner of the square tray illustrated. The flutes and the provision of the fluted surface 20, 22, 24 are decorative but they are also functional in the sense that they provide vertical stability to the sidewalls and minimize distortion upon vertical loading when the lid is closed and the filled containers are stacked vertically, one upon the other. This too will be explained in more detail subsequently.

The flutes 22 and 24 slope outwardly from the planar surface 20 from the bottom to the top at an angle of about 3° . Note also that the edges of the flutes are rounded. Because the flutes diverge along the sidewalls in an upward direction they increase in cross-section vertically. The diverging, sloped configuration also assists in easy disengagement of individual trays from a stacked, stored column of trays.

At a distance of about ¼ inch from the open top 26 of the tray, at each of the four corners is a shelf 28. The purpose of the shelf is to provide a slight separation of the containers when they are stacked in an open and empty condition. When the packages are so stacked, the shelf or ledge 28 will rest on the upper surface of an outwardly projecting flange 30 circumscribing the open top 26. Thereby, the bottoms 16 and flanges 30 of the vertically nesting containers will be separated from corresponding flanges and bottoms of adjacent containers by about ¼ inch. Thus, the sidewalls and bottoms will not tend to stick together when they are packaged and shipped together in nested condition.

Figure 3:
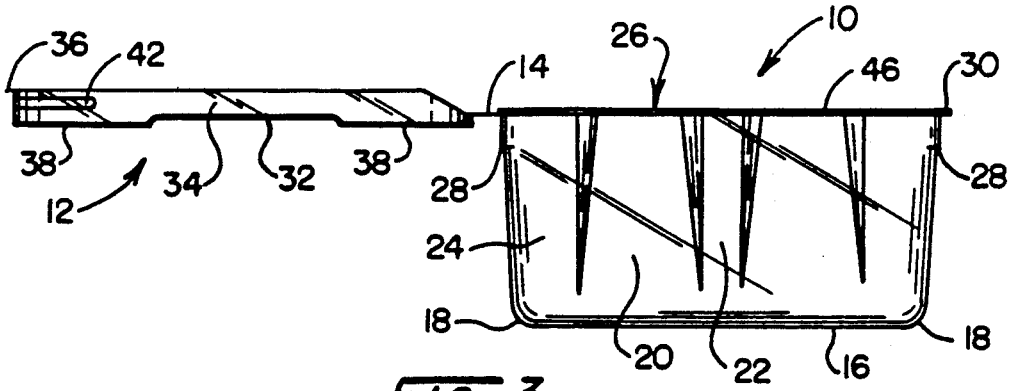
FIG. 3 is a side elevational view of the tray of FIG. 2.
Figure 4:
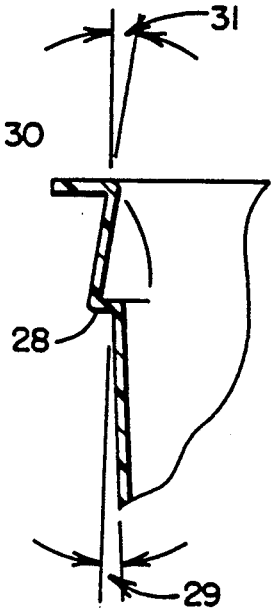
FIG. 4 is a fragmentary sectional view taken along line 4—4 of FIG. 2.

To further enhance the separability of the nested packages, the rounded surface at the corners between shelf 28 and flange 30 is angled inwardly at an angle 29 of about 3° , see FIG. 4. That is, there is a change in angular relationship from the outwardly angled flute 24 of 3° to the bridging section which is inwardly angled 31 at about 3° , making a total of about 6° in change of angle. This structural relationship is best seen in FIGS. 3 and 4.

The cover 12 includes a planar surface 32 extending over approximately the full geometric area in relationship to the open top 26. The cross-sectional areas of planar surface 32 and bottom 16 are approximately equal. A downwardly extending lip 34, perhaps best seen in FIG. 5, terminates in an outwardly projecting shoulder 36. The shoulder or flange 36 is designed to help strengthen the cover and by maintaining its geometric integrity. In the embodiment illustrated in FIGS. 1–5, the shoulder 36 extends around three sides of the cover, there being no need for such structure on the side of the cover joined to the tray 10 by hinge 14.

At the four corners of the cover are upwardly projecting geometric shapes 38 which in this illustration resemble rectangles with rounded corners bent at a 90° angle. The purpose of geometric shapes 38 raised above surface 32 is to provide feet or lugs for engaging bottom 16 of the tray 10. When the tray is filled with goods, the lid closed, and the filled packages stacked one upon the other, as in a refrigerated dairy display case, the corners 18 are configured to fit within the inward curve 40 of lugs 38, see FIG. 2. Thereby, flat bottom 16 of tray 10 fits on planar surface 32 of the cover, and assumes a nesting or mating relationship between corners 18 and curved surfaces 40 to prevent vertically stacked packages from sliding sideways.

The particular structure of lugs 38 shown in this illustration is merely one example of any number of geometric shapes which may be formed on the lid to mate with some corresponding mirror image geometric shape on the bottom 16 of tray 10. The number of indentations and projections to provide this stackability depends on a number of factors which will be determined by the designer of the package elements and their intended use.

In the FIGS. 1–5 embodiment, lip 34 of cover 12 projects downwardly below the outwardly projecting flange 30 circumscribing the open top 26 of tray 10, and shoulder 36 in combination with lip 34 tends to maintain the planar relationship of the cover so there will be no upward bowing or bulging. Bulging might allow the incursion of air and airborne debris which would tend to contaminate and dry the cheese or other food products in this package.

Figure 5:
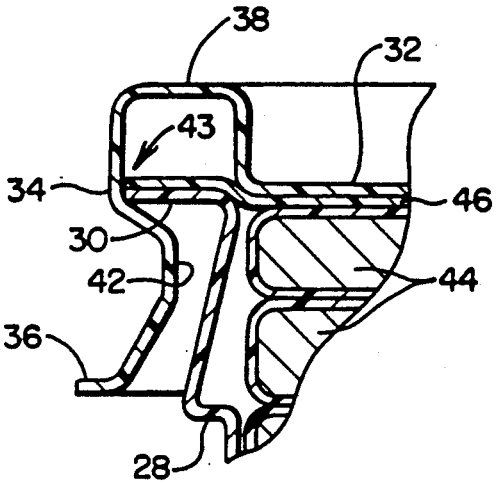
FIG. 5 is a fragmentary sectional view taken along line 5—5 of FIG. 2 but with the lid closed.

To lock the package in closed position, a pair of inwardly projecting ridges 42, see FIG. 5, are formed in the lip 34 at each of the two corners most remote from hinge 14. The geometric relationship between ridges 42 and flange 30 is such that flange 30 flexes downwardly under pressure from the ridges 42 during closing. Then, just before the flat surface 32 descends to the plane of flange 30, the deflected outer edge of flange 30 slips past ridge 42 and snaps into space 43 below lug 38 and above ridge 42. The pressure required to close the cover is not great because it is intended that the cover may be hand manipulable by any normal consumer, and mere finger pressure should be adequate to open and close the cover.

Note particularly FIG. 5 which illustrates a tray filled with cheese slices 44. A seal film or sheet 46 covers the open top 26 of the tray and is sealed completely around the periphery of the top 26 to seal the tray contents in an air and moisture tight condition. The ridges or locking beads 42 pull the planar surface 32 of the lid down into contact with the seal sheet 46. The seal sheet is deflected downwardly by the lid about 0.03 inches and into contact with the goods in the tray. It is intended that the seal sheet 46 be of clear plastic. Also, an over wrap (not shown) around the goods will have an indicia facing the lid and the tight juxtaposition of the goods, sheet, and lid will allow easy visual recognition of the brand name or other information. Thereby, exterior labels or embossing on the tray may be unnecessary.

Exterior labels and embossing are an option which may be used in this context if desirable.

Figure 8:
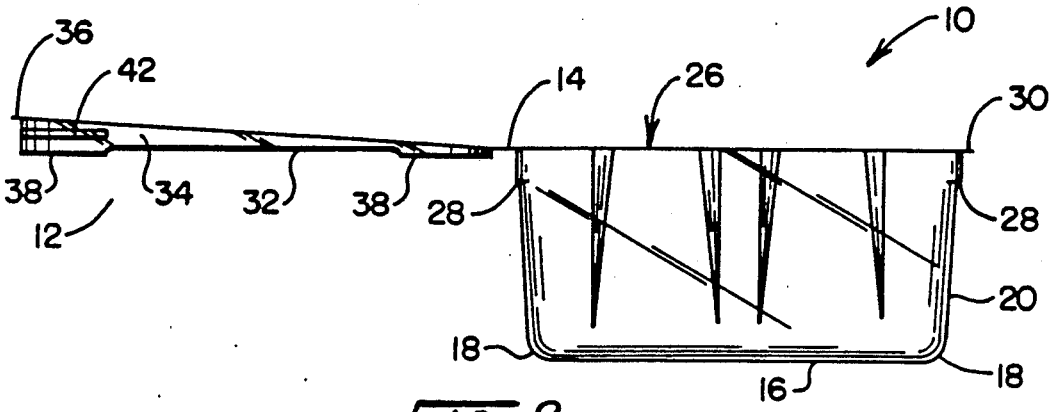
FIG. 8 is a side elevational view of the tray of FIG. 6.
Figure 6:
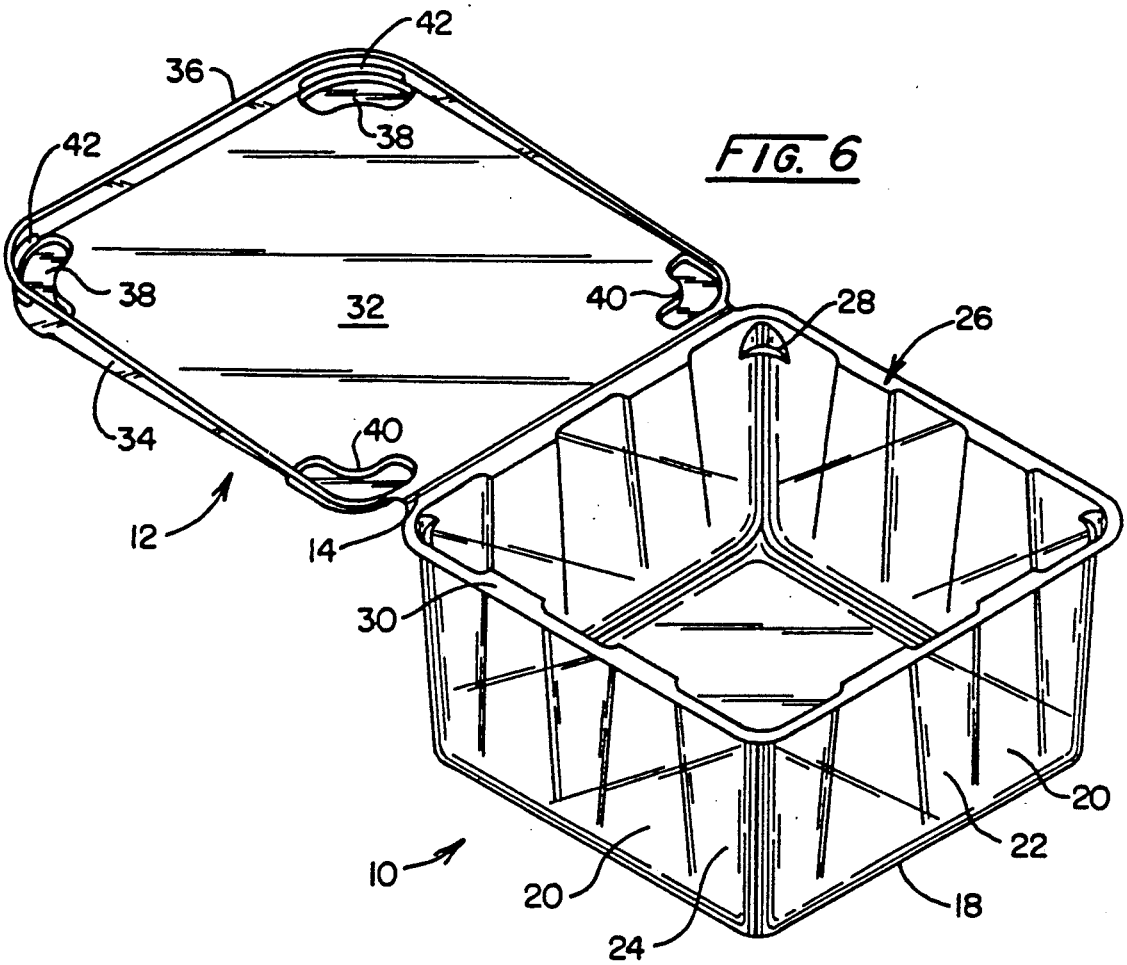
FIG. 6 is a perspective view of a second embodiment of the tray and cover combination.
Figure 7:
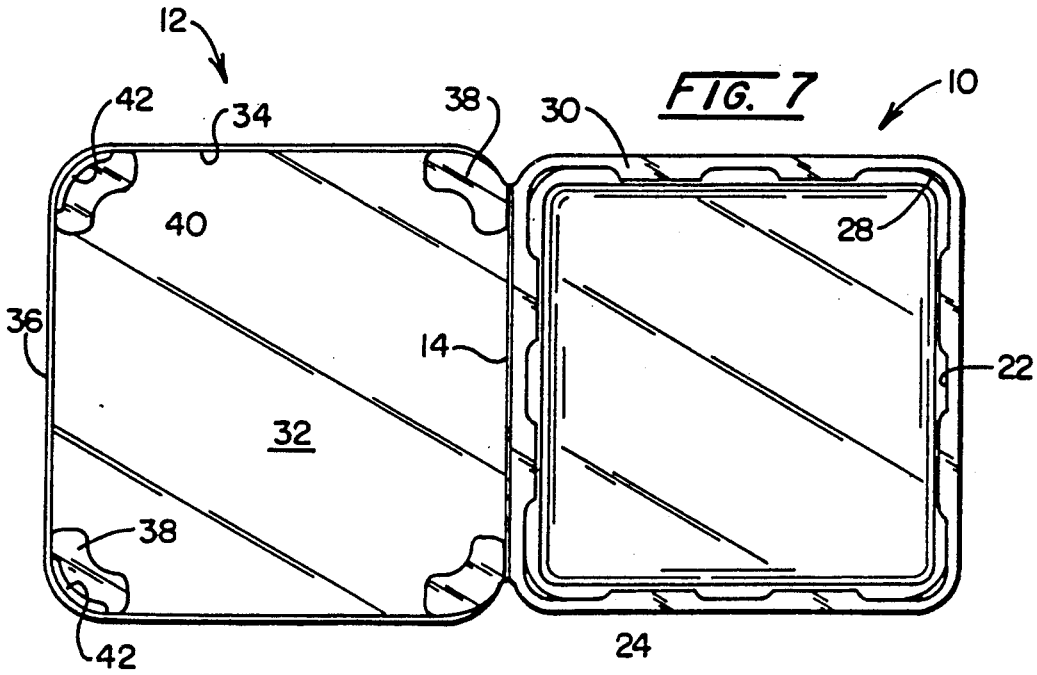
FIG. 7 is a top plan view of the fully opened tray illustrated in FIG. 6.

A second embodiment is illustrated in FIGS. 6–8. The tray described in relation to FIGS. 1–5 is equally applicable to the tray of FIGS. 6–8 except that the lid is wedge-shaped in profile as best seen in FIG. 8. Also the ridge around the edge of the lid of FIGS. 1–5 is eliminated, thereby the planar surface 32 is of a greater cross-ssectional area than the bottom 16.

Having thus described the invention in its preferred embodiments, modifications will be obvious to those having ordinary skill in the art. It is not intended that the drawings illustrating the preferred embodiments nor the language used to describe the same be limiting on the invention. Rather it is intended that the invention be limited only by the scope of the appended claims.

We claim:

1. A package comprising a tray and a cover, said tray being formed of a resin and having a bottom, vertically extending sidewalls joined together at corners and having an open upper end, and a horizontally extending sealing surface adjacent the open upper end of said sidewalls, vertically extending flutes on the exterior of said sidewalls to increase structural stability, said flutes extending outwardly of the sidewall, one of said flutes at each vertically extending corner extends from one sidewall to the other, an outwardly extending flange on the sidewalls adjacent said open upper end, said flange comprising said sealing surface, a transparent sealing sheet extending across said upper end of said tray and sealingly bonded to said flange after goods have been placed in said tray to thereby seal said gods in air-tight relationship within said tray, an outwardly projecting shelf formed only at each corner, each said shelf being located intermediate the sidewall flange and the tray bottom, each said shelf extending a distance outwardly whereby it will engage the surface of a flange corresponding to said flange if inserted into an identically shaped tray to thereby space apart the bottoms of such trays, said cover being integrally formed with said flange and including a generally planar surface which is about the same size and configuration as said bottom of said tray, a mating lip on said cover extending around and transverse to the planar surface, at least part of said mating lip circumscribing a cross-sectional area parallel to said planar surface which is greater than the cross--sectional area circumscribed by said flange n a plane parallel to said open upper end, means forming a hinge between said cover and said flange, said cover having an upper surface configured to receive a surface corresponding to the lower surface of said tray bottom and hold it in general vertical alignment in a stack of covered trays, the lip including an outwardly extending shoulder at its periphery to hold the cover in a stable configuration and minimize bowing of the cover intermediate the corners of the tray, locking beads formed in said lip being configured to snap into place below said flange on said sidewalls and thereby pull said planar surface of said lid downward into contact with said sealing sheet in a locked position, said planar surface depressing said sealing sheet about 0.03 inches below the surface of said flange and into engagement with the goods in said tray.

2. The package of claim 1, including geometric patterns in relief within the upper surface of the planar surface of the cover and the outer surface of the tray bottom, said geometric patterns being mirror images of each other.

3. The package of claim 2 wherein the tray surface at each corner converges in both the upward and downward directions from said shelf at an angle of about 3°.

4. The package of claim 3 wherein the hinge between the tray and lid is formed as a groove bridging the space between the flange at the top of the tray and the edge of the lid.

5. The package of claim 2 wherein the hinge between the tray and lid is formed as a groove bridging the space between the flange at the top of the tray and the edge of the lid.

6. The package of claim 1 wherein the tray surface at each corner converges in both the upward and downward directions from said shelf at an angle of about 3°.

7. The package of claim 1 wherein the hinge between the tray and lid is formed as a groove bridging the space between the flange at the top of the tray and the edge of the lid.

* * * * *